US007048331B2

(12) United States Patent
Saakyan

(10) Patent No.: US 7,048,331 B2
(45) Date of Patent: May 23, 2006

(54) UNIVERSAL, PORTABLE, FOLDABLE, HEAVY DUTY, LIGHT WEIGHT CHAIR

(76) Inventor: Razmik Saakyan, 533 W. Dryden St., Glendale, CA (US) 91202

( * ) Notice: Subject to any disclaimer, the term of this patent is extended or adjusted under 35 U.S.C. 154(b) by 31 days.

(21) Appl. No.: 10/951,535

(22) Filed: Sep. 28, 2004

(65) Prior Publication Data

US 2006/0071512 A1 Apr. 6, 2006

(51) Int. Cl.

| | |
|---|---|
| ***A47C 4/28*** | (2006.01) |
| ***A47C 16/02*** | (2006.01) |
| ***A47C 7/22*** | (2006.01) |
| ***A47C 4/38*** | (2006.01) |
| ***A47D 1/02*** | (2006.01) |

(52) U.S. Cl. ..... 297/16.1; 297/16.2; 297/24; 297/25; 297/26; 297/29; 297/42; 297/45; 297/423.39; 297/423.41; 297/452.63

(58) Field of Classification Search ..... 297/16.1, 297/16.2, 17, 24, 25, 26, 29, 42, 45, 423.39, 297/423.41, 452.63

See application file for complete search history.

(56) References Cited

U.S. PATENT DOCUMENTS

| | | | | |
|---|---|---|---|---|
| 3,123,395 | A * | 3/1964 | Glass | 297/16.1 |
| 3,182,614 | A * | 5/1965 | McLean | 297/26 X |
| 3,874,730 | A * | 4/1975 | Marchello | 297/452.63 |
| 4,176,880 | A * | 12/1979 | Marchello | 297/452.63 |
| 4,544,203 | A * | 10/1985 | Younger et al. | 297/423.41 X |
| 5,044,690 | A * | 9/1991 | Torrey | 297/16.1 |
| 6,591,778 | B1 * | 7/2003 | Alderman | 297/16.1 X |
| 2004/0232740 | A1 * | 11/2004 | Enge | 297/16.2 |

FOREIGN PATENT DOCUMENTS

| | | | | |
|---|---|---|---|---|
| CH | 683311 | A5 * | 2/1994 | 297/16.2 |

* cited by examiner

*Primary Examiner*—Rodney B. White

(57) ABSTRACT

A universal heavy duty, light weight, portable, foldable chair according to the present disclosure comprises a frame 1 comprising four shaped supports 11*a*, 12*a*, 13*a*, 14*a* held together and in position at the center by a hollowed cylinder hinge 15*a*. The seat comprises of two cloths 16*a* and 16*b*. There exists one piece of cloth 18*a* and 18*b* at each side of the chair to act as stabilizer for the frame and the chair as a whole. Cloth 21*a* will be connected to the two piece cloth assembly 22*a* at one end and have a locking mechanism 23*a* at the other to lock with one end of 21*b*. Cloth 21*b* will be connected to the two piece cloth assembly 22*b* at one end and have a corresponding locking mechanism 23*b* to fit the mechanism 23*a* at the end of the cloth 21*a*.

3 Claims, 6 Drawing Sheets

UNIVERSAL, PORTABLE, FOLDABLE, HEAVY DUTY, LIGHT WEIGHT CHAIR

CROSS-REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND OF THE INVENTION

1. Field of the Invention

The present invention relates to a universal, portable, foldable chair. More specifically, the present invention concerns to a universal heavy duty, light weight, portable, foldable chair which consists of a frame, frame stabilizers, seat, and a locking mechanism to: hold the frame sturdy while in use, keep the chair compacted when in the folded position, and to harness the chair during storage or when being carried.

2. Description of the Prior Art

In many household, commercial, leisure, and military settings it is desirable to have a portable, foldable, heavy duty, light weight chair. It is known in the art to create a chair that can be easily carried and stored. Furthermore it is known that a sturdy comfortable yet compact chair is useful and convenient. Additionally it is known in the art to design a portable chair which is strong enough to hold, for example, at least a 200 pound person. However, these prior art folding chairs are problematic for overweight persons. Further more the prior art is not durable for long time use by overweight or military personal. The reason being these category of people have either a heavy weighing body or are carrying heavy equipment on there clothing in which the chair can not withstand for excessive use and pressure. Additionally prior art foldable portable chairs are relatively bulky and heavy if they are intended for use by a person who is over 200 pounds, requiring undesirable amounts of storage space and/or creating a difficulty when being carried.

BRIEF SUMMARY OF THE INVENTION

A universal heavy duty, light weight, portable, foldable chair is very useful at home or on trips. In this specification a universal heavy duty, light weight, portable, foldable chair is called "a foldable chair" hereinafter. Some other uses for a foldable chair, but not limited to, are: fishing, camping, sporting events, children gatherings, for emergency personal such as paramedics for people in stress that must sit down, and for army and related fields. A folding chair can also be used as a leg rest or small table. Furthermore, a folding chair so compact can be easily put into a persons pocket or handbag. A foldable chair is usually assembled with a chair frame made of bent steel rods, hinge at the center, cloth frame stabilizers, and a seat cloth thereon. Of course the chair frame can be made of various materials including but not limited to hollow steel rods, plastic hollow and solid rods. The hinge which holds the four piece frame assembly intact and allows for the chair to be folded can be made of hollow steel. Of course the hinge can also be made of plastic hollow or solid as well as a solid piece of steel. The seat cloth and frame stabilizers are made of a woven fabric with sufficient strength. Of course the seat cloth and frame stabilizers can also be made of various materials as well. The locking mechanism can be of any type and material but allow for easy locking and unlocking.

Conventional folding chairs are not designed to hold as much weight in comparison with its own size and weight as this folding chair can. For example a prototype of this folding chair was tested. The prototype was 11.5 inches high by 11.5 inches long and 6 inches wide, the chair held up a person weighing approximately 400 pounds. This shows the stability and capacity of the chair, even of the small prototype. Furthermore, conventional folding chairs do not fold into such a compact size in comparison with its own size and weight when at the unfolded usable position as this chair does. The proto type mentioned before was also measured when folded. The measurement when folded is as follows: 8 inches by 6 inches by 1 inch. Furthermore the chair can be carried in a persons pocket or handbag with no discomfort or waste of space.

Accordingly, there exists a need for a universal heavy duty, light weight, portable, foldable chair which can be used conveniently and conventionally. Furthermore, a folding chair which will be easily carried and stored.

BRIEF DESCRIPTION OF THE DRAWING FIGURES

Preferred embodiments of the present invention are described in detail below with reference to the attached drawing figures, wherein.

DETAILED DESCRIPTION OF THE PREFERRED EMBODIMENTS

Figure 1:
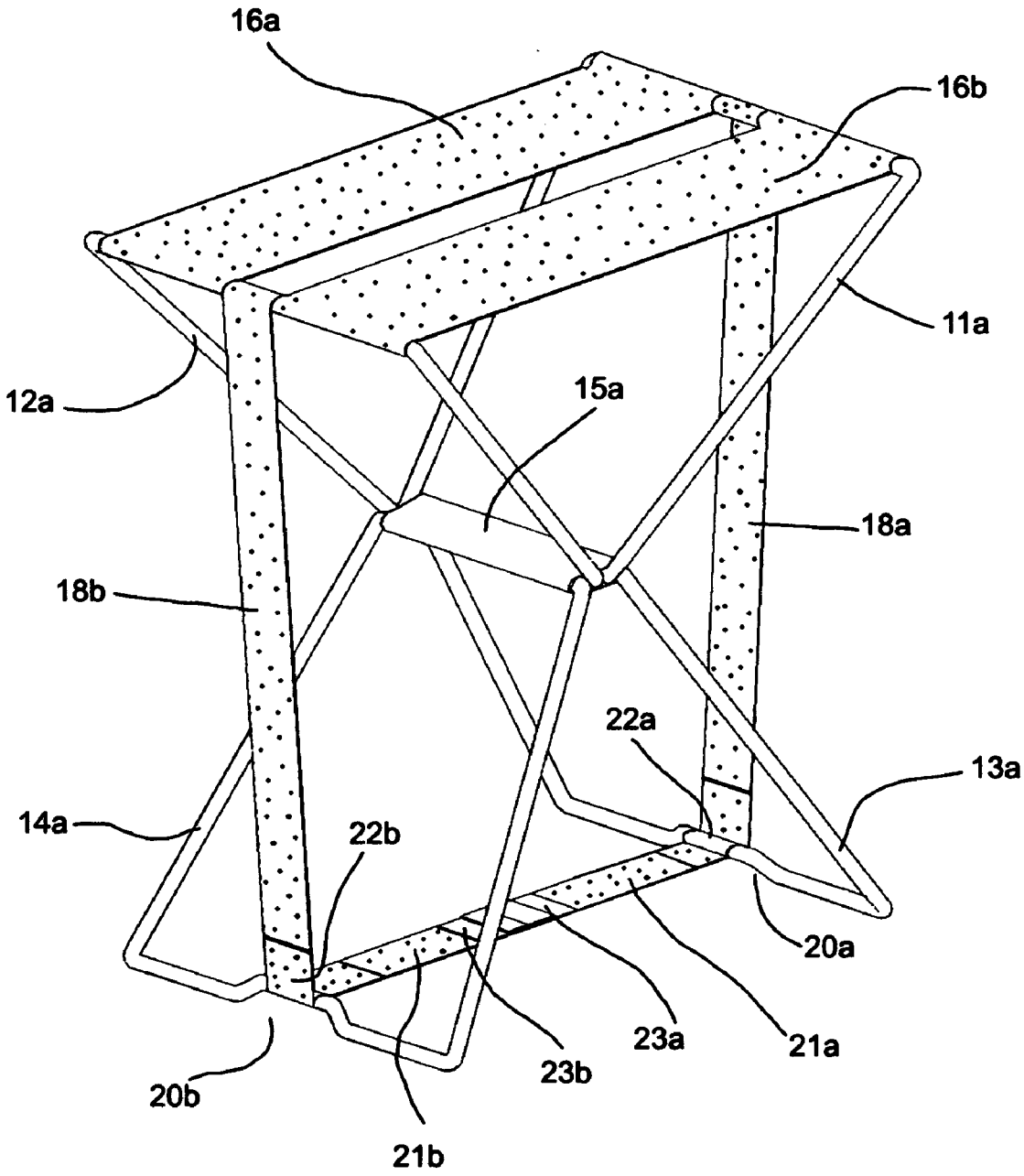
FIG. 1 is a perspective view of the foldable chair in accordance with the present invention.
Figure 2:
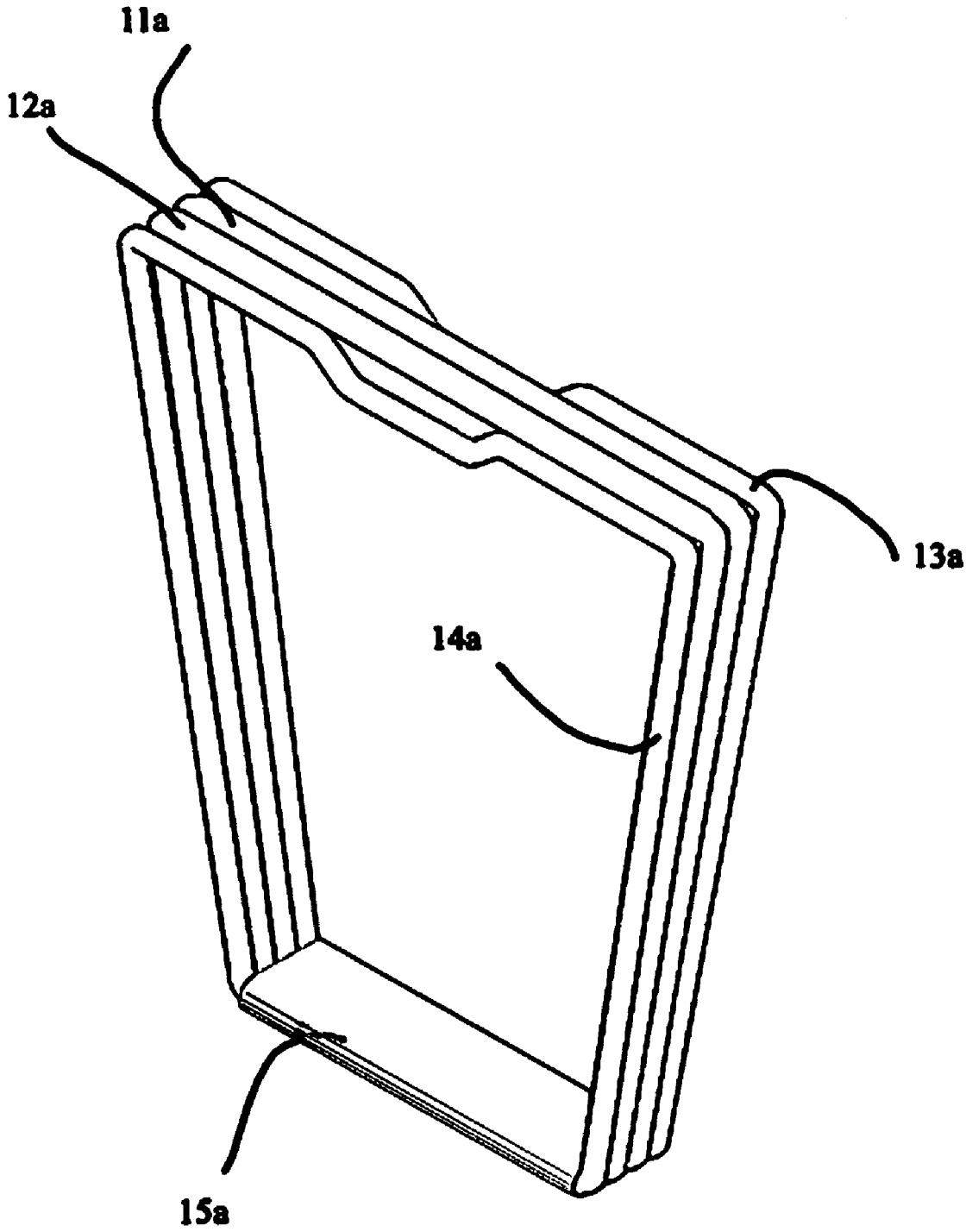
FIG. 2 is a perspective view of the X shaped frame in its folded position, without the cloth parts assembled.
Figure 3:
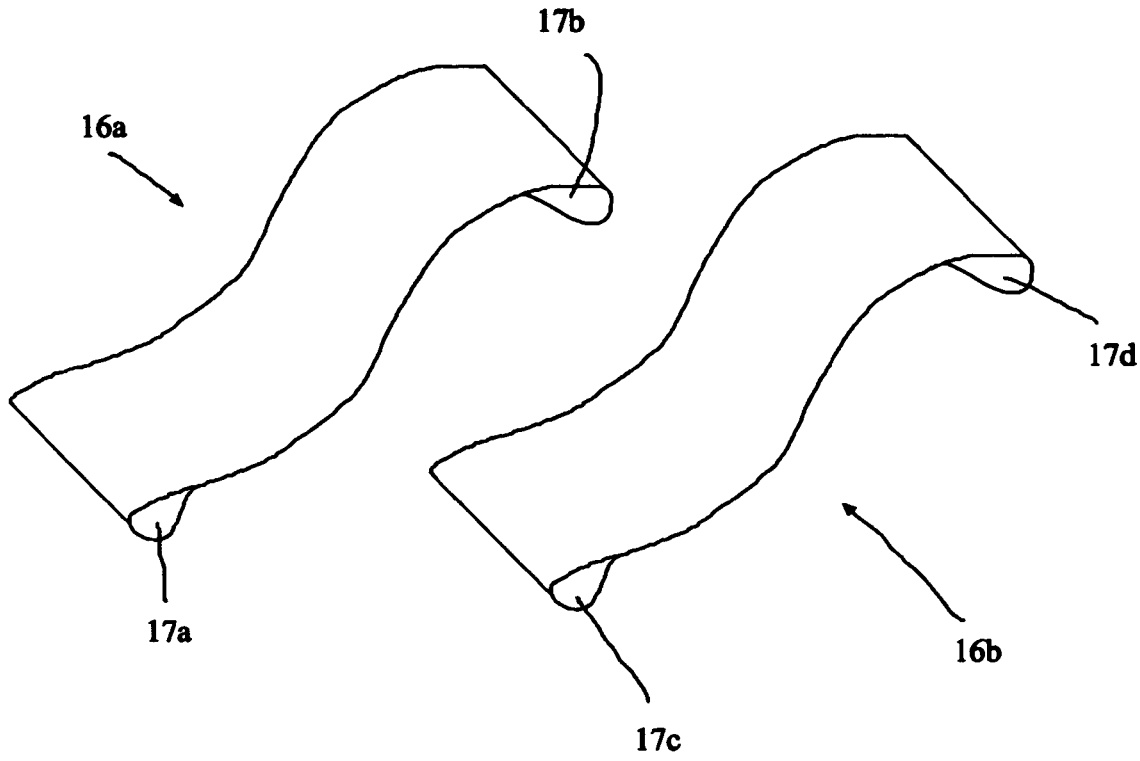
FIG. 3 is a perspective view of the seat cloth parts with the ends folded to form a loop in order for the frame rods to be accepted.
Figure 4:
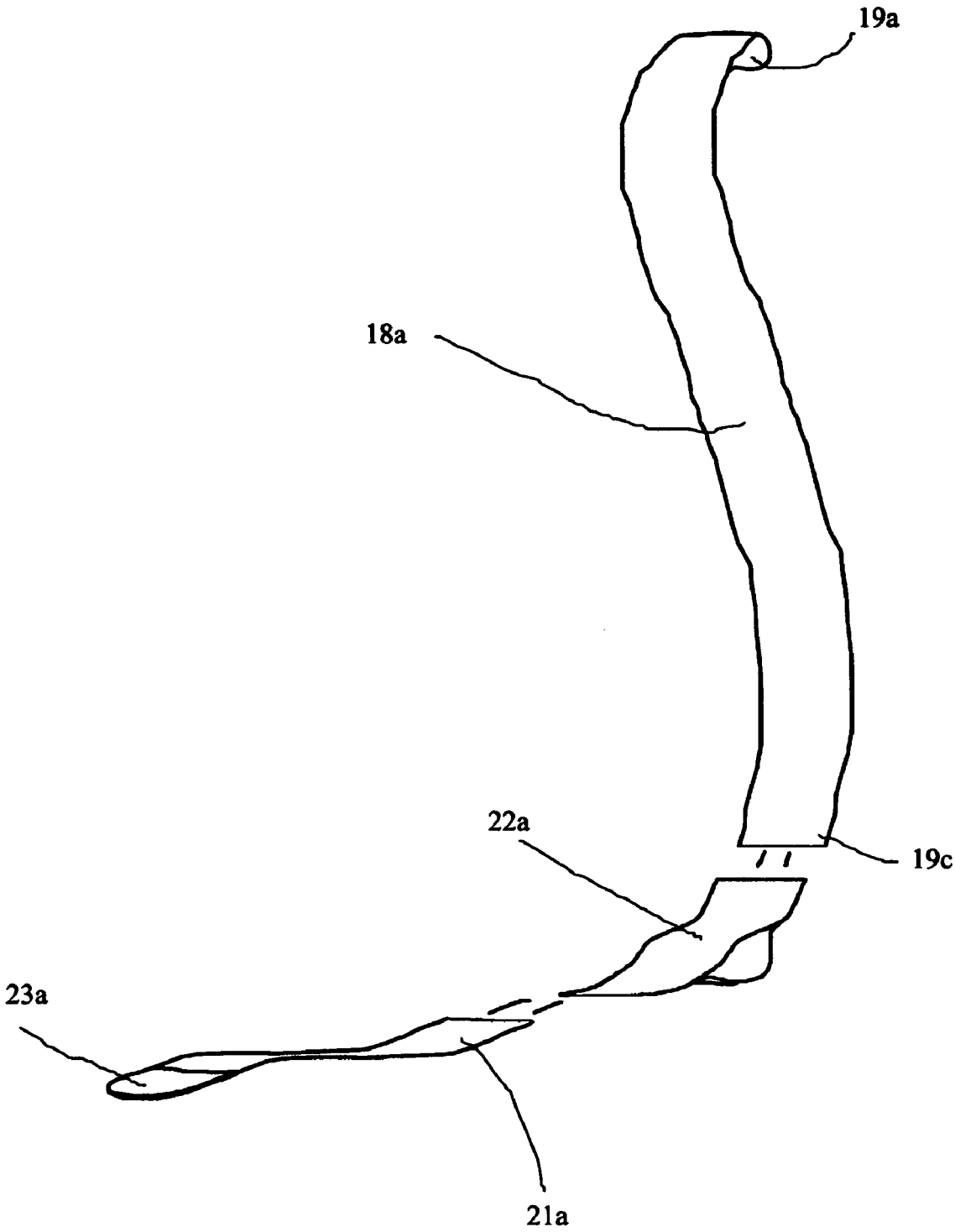
FIG. 4 is a perspective view of the cloth frame stabilizers the cloth strip to be connected to the locking mechanism at the bottom of the chair, and the two piece cloth assembly to connect the frame stabilizers cloth strip to be connected to the locking mechanism.
Figure 5:
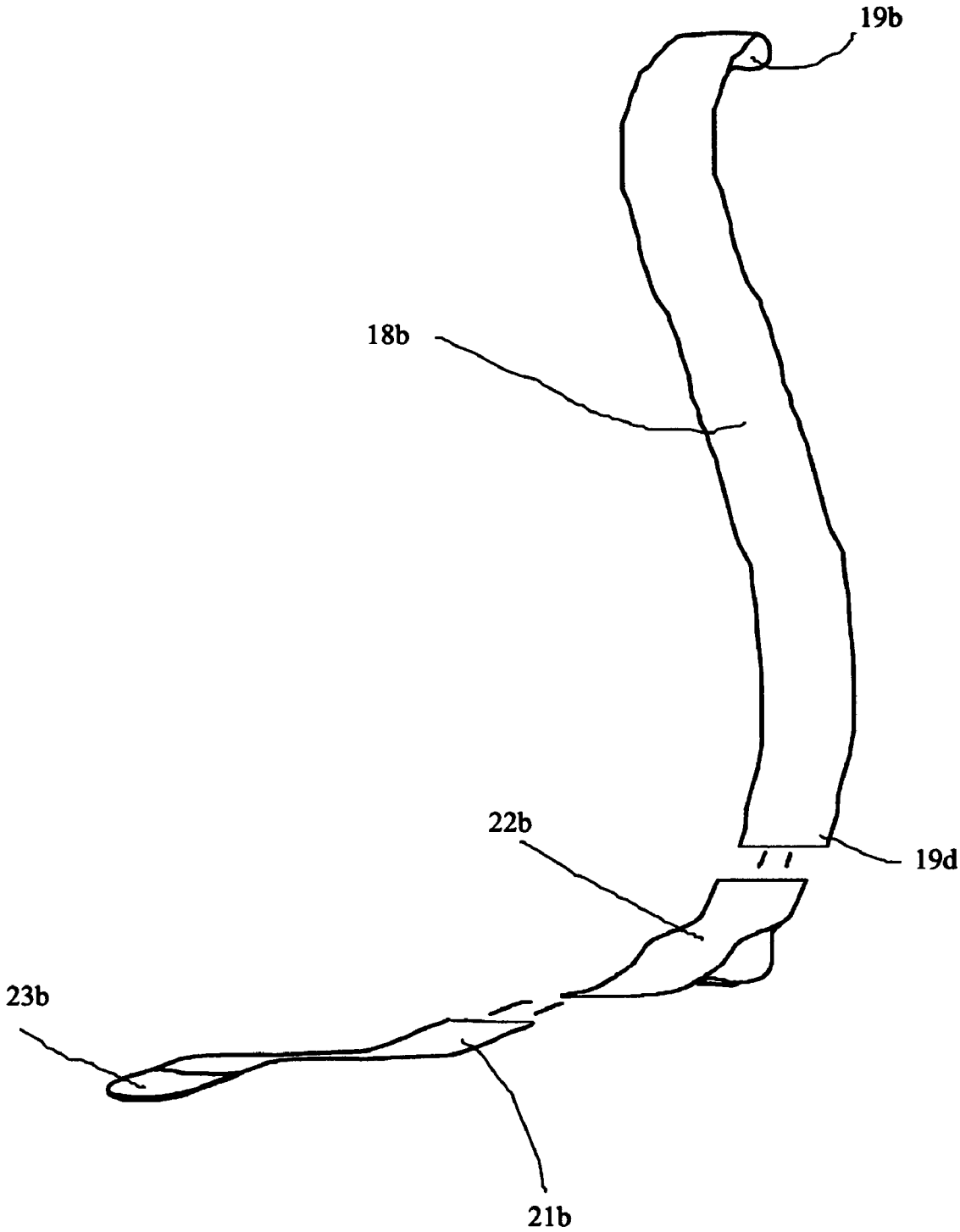
FIG. 5 is a perspective view of the cloth frame stabilizers the cloth strip to be connected to the locking mechanism at the bottom of the chair, and the two piece cloth assembly to connect the frame stabilizers cloth strip to be connected to the locking mechanism.
Figure 6:
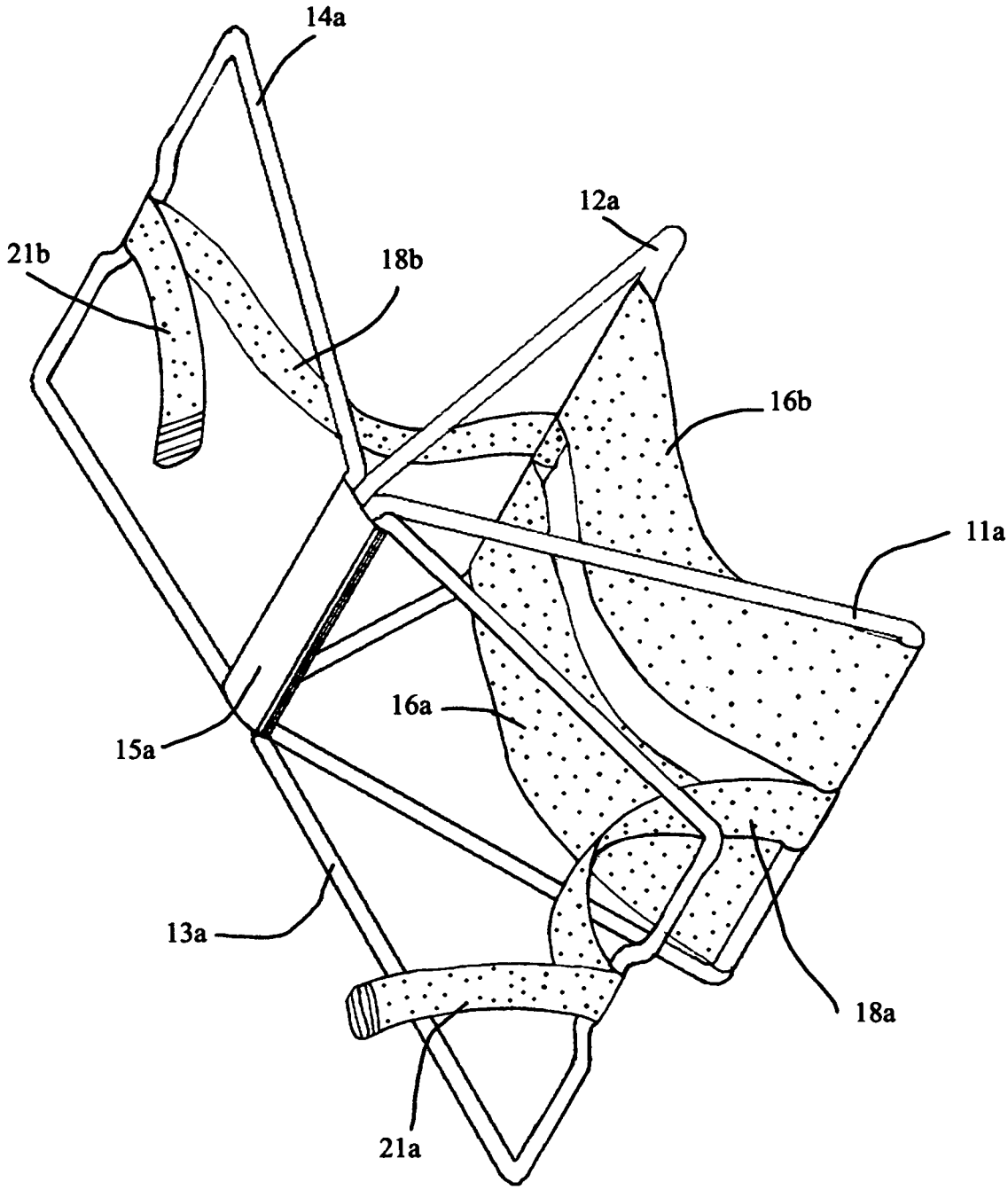
FIG. 6 is a perspective view of the foldable chair at a partially folded position and all parts of the chair assembled.

FIG. 1 illustrates a universal heavy duty, light weight, portable, and foldable chair according to the present disclosure comprises a frame 1 comprising four shape supports 11*a*, 12*a*, 13*a*, 14*a* held together and in position at the center by a hollowed cylinder hinge 15*a*. The hinge allows the four frame parts to rotate freely when the chair is unlocked and is to be folded or opened, as shown in FIGS. 1–2 and FIG. 6. The seat comprises of two cloth straps 16*a* and 16*b*. The seat straps are made of a strong fabric, preferably canvas or oxford cloth. Both ends of the seat straps are folded and connected to itself to form loops 17*a*, 17*b*, 17*c*, 17*d* where the frame rods 11*a* and 12*a* will be received. Cloth straps 18*a* and 18*b* are attached to each side of the chair. One end of each strap 18*a* and 18*b* is folded and connected to itself to form a loops 19*a* and 19*b* where the frame rods 11*a* and 12*a* will be received. The other ends of the cloths straps 18*a* and 18*b* will be cut straight, as shown in FIG. 5 19*c* and 19*d*. At the bottom of the chair, the two frame rods 13*a* and 14*a* have indented sections 20*a* and 20*b*. A two piece cloth assembly 22*a* and 22*b* connects the cloth bands 18*a* and 18*b* to 21*a* and 21*b*. Cloth band 21*a* will be connected to the two piece cloth assembly 22*a* at one end and have a locking mechanism 23*a* at the other to lock with one end of cloth band 21*b*. The locking mechanisms should preferably be one which will allow a strong hold when in use yet be easily unlocked to allow for folding of the chair. For examples, a hook and eyelet mechanism can be used. Cloth band 21*b* will be connected to the two piece cloth assembly 22*b* at one end and have a corresponding locking mechanism 23*b* to fit the mechanism 23*a* at the end of the cloth band 21*a*.

I claim:

1. A foldable chair comprising:

an X-shaped frame movable between a folded, closed position and an unfolded, use position for being supported on a floor, the foldable frame comprising four shaped rods, said rods held together by a central hinge and pivotally rotatable relative to one another along said central hinge, two of said shaped rods forming a bottom portion of said frame having a first and a second side and adapted to support the frame on a floor in the unfolded, use position, said two rods having an indented section and positioned on a first and a second side of bottom portion when in the unfolded, use position, said indented sections free from contact of the floor when the frame is in the unfolded, use position for being supported on the floor;

the other two rods of said frame forming a top portion when in the unfolded, open position, said top portion having a first and second side;

a first pair of straps extending from the first side to the second side of the top portion of the frame, said two straps forming a seat when the frame is in the unfolded, use position; and a second pair of straps having a top end and a bottom end, one of said second pair of straps connected to and extending downwardly from the first side of the top portion of the frame to the bottom portion of the frame when the frame is in the unfolded, use position, and the other of said second pair of straps connected to and extending downwardly from the second side of the top portion of the frame to the bottom portion of the frame when the frame is in the unfolded, use position, the second pair of straps connecting the top portion of the frame to the bottom portion of the frame when the chair is in the unfolded, use position;

a third pair of straps, each strap having one end connected to the bottom ends of said second pair of straps and a second end connected to a locking mechanism when the foldable chair is the an unfolded, open position to be supported on a floor and to accommodate a seated occupant.

2. The foldable chair as claimed in claim 1, wherein the two straps are connected to the indented sections of the frame at the bottom.

3. The foldable chair as claimed in claim 2, wherein the locking mechanisms on each of the third pair of straps is adapted to be locked together when the chair is in the unfolded, use position to support a person seated on the chair or when the frame is to be stored or carried in the folded, closed position.

* * * * *